United States Patent [19]

Howland et al.

[11] 4,327,558

[45] May 4, 1982

[54] UNLOADABLE TRANSPORT REFRIGERATION UNIT CONTROL

[75] Inventors: Leland L. Howland, Belle Plaine; Hendrie J. Grant, St. Paul; David H. Taylor, Bloomington, all of Minn.

[73] Assignee: Thermo King Corporation, Minneapolis, Minn.

[21] Appl. No.: 188,170

[22] Filed: Sep. 17, 1980

[51] Int. Cl.[3] ..... F25B 13/00; F25B 1/00

[52] U.S. Cl. ..... 62/160; 62/196 A; 62/196 B; 62/228

[58] Field of Search ..... 62/159, 160, 196 R, 62/196 A, 196 B, 278, 228 C, 228 D, 324.6; 236/1 EA

[56] References Cited

U.S. PATENT DOCUMENTS

| | | | |
|---|---|---|---|
| 2,920,812 | 1/1960 | Courtney, Jr. | 62/228 C |
| 2,962,873 | 12/1960 | Anderson | 62/196 B |
| 3,010,289 | 11/1961 | Kuklinski | 62/196 |
| 3,768,274 | 10/1973 | Fink | 62/324.6 |

*Primary Examiner*—Albert J. Makay
*Assistant Examiner*—Harry Tanner
*Attorney, Agent, or Firm*—E. C. Arenz

[57] ABSTRACT

A hot gas pressure switch 29 is provided to be responsive to pressure in a hot gas line 22 which will have a significant pressure value only during a heat or defrost mode, to unload cylinders of a transport refrigeration compressor to avoid overload, so that the compressor can operate with a substantially greater discharge pressure in a cooling mode without penalty.

3 Claims, 4 Drawing Figures

UNLOADABLE TRANSPORT REFRIGERATION UNIT CONTROL

BACKGROUND OF THE INVENTION

1. Field of the Invention

This invention relates to control of a transport refrigeration unit that has at least heating and cooling capabilities and an unloadable compressor.

2. Description of the Prior Art

In many typical transport refrigeration units a throttling valve is provided in the suction line to which the refrigerant returns to the compressor. This valve, sometimes referred to as a suction hold-back valve, regulates the amount of refrigerant returning to the compressed compressor and by controlling this amount the load can be controlled to limit the horsepower required, particularly in a heating or defrost mode, to prevent an overload of the driving engine. While it would be desirable to eliminate the throttling valve, both because of its initial cost and because it adds some restriction at all times in the line, some means is still required for avoiding overload with higher suction pressures. Of course the typical high pressure cutout will function to stop the operation with an excessive head pressure when heating, but this results in cycling of the unit.

U.S. Pat. No. 3,010,289 discloses an arrangement for a transport refrigeration unit control which includes a high pressure switch which can function to unload the compressor when a predetermined abnormally high head pressure in the cylinders of the compressor is sensed. This partial unloading will occur with a high head pressure while the refrigeration system is operating either on a heating or a cooling cycle. This arrangement is considered disadvantageous since in a cooling mode significantly higher discharge and suction pressures can be accommodated without an overload problem than in a heating or defrost mode.

It is the aim of this invention to provide a transport refrigeration unit and control arrangement in which the throttling valve is eliminated, and in which the disadvantage of the arrangement of the noted patent is also avoided.

SUMMARY OF THE INVENTION

In accordance with the invention a transport refrigeration unit has a multi-cylinder unloadable compressor adapted to operate in a cooling mode or alternatively in a heating and defrost mode, in accordance with positioning of a three-way valve receiving hot gas discharge by the compressor, with the valve having its one outlet connected to a refrigerant condenser and its other outlet connected to a hot gas line extending to the refrigerant evaporator, with the hot gas line in a cooling mode having a pressure reflecting the evaporator pressure and in the heating and defrost mode having a pressure corresponding generally to the gas discharge pressure. This unit is provided with a control system which includes switch means responsive to the refrigerant pressure in the hot gas line, first conduit means including a first solenoid for controlling the loading of at least one of the cylinders of the compressor, second circuit means including a second solenoid for controlling the loading of the remainder of the cylinders, with each of the circuit means including switch means responsive to changes in temperature of the space conditioned and independently operable to positions to unload said at least one cylinder and said remainder of cylinders in accordance with demand conditions of the space. The switch means responsive to pressure has a first position corresponding to a pressure below a predetermined value placing the second circuit means in a condition in which the second solenoid loads the remainder of the cylinders, and has a second position corresponding to a pressure above the predetermined value placing the second circuit means in an opposite condition in which the second solenoid unloads the remainder of the cylinders, so that the system can operate in a cooling mode in a loaded condition with gas discharge pressure significantly higher than the predetermined value at which the hot gas line switch means operates.

DESCRIPTION OF THE PREFERRED EMBODIMENT

Figure 1:
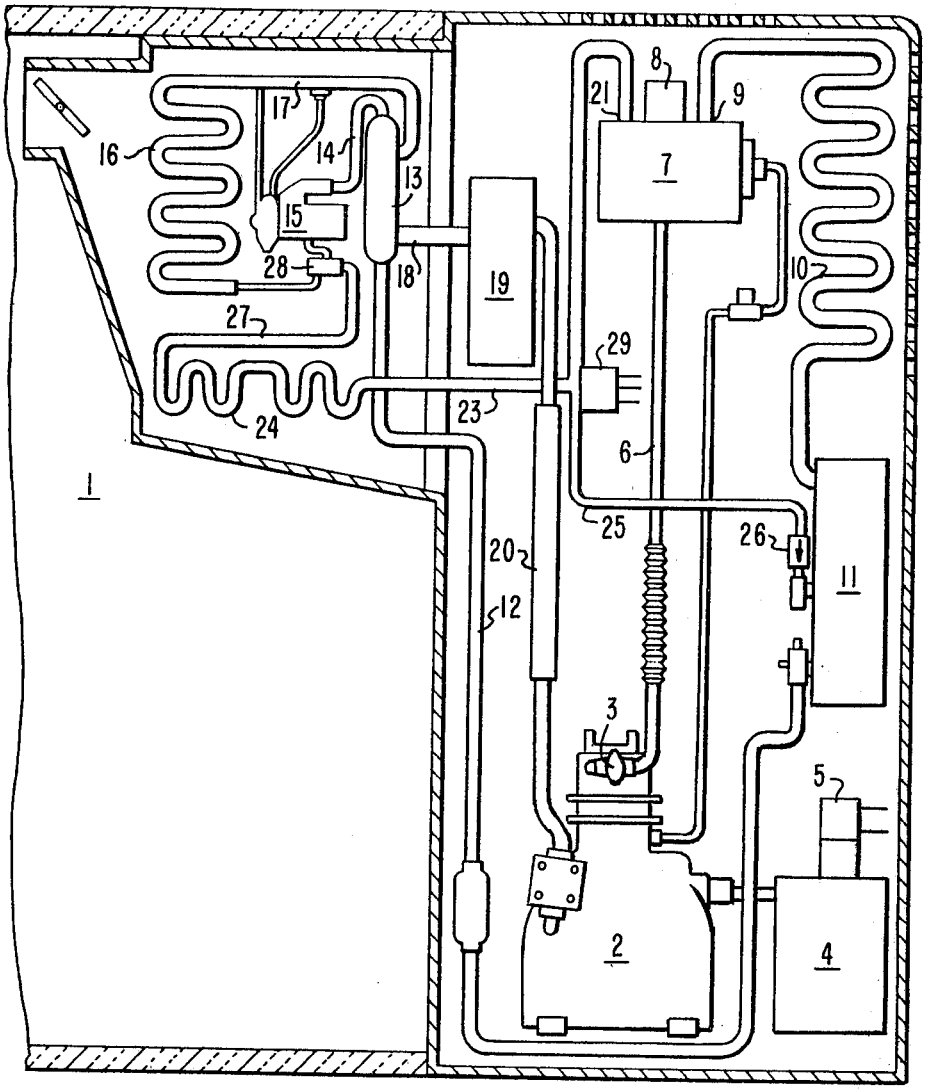
FIG. 1 is a somewhat schematic view of the main parts of a transport refrigeration system of the type to which the invention is applied for example.

Referring to FIG. 1, a transport refrigeration unit of mostly conventional parts is provided to serve the space 1 within an insulated trailer or the like. Most of the main parts are shown in schematic form since the system shown is for the most part conventional for purposes of this application and available from the assignee of this application.

A refrigerant compressor 2 having, for example, three cylinders with unloaders as schematically illustrated at 3, is driven by the schematically illustrated prime mover 4 which, for purposes of this example, is an engine provided with speed control means electrically operated by the solenoid 5 to obtain two different speeds. In the currently preferred arrangement the unloaders are oil pressure operated valves, with the valves controlled by solenoids.

The compressor 2 discharges hot gas through line 6 to the three-way valve 7 controlled by the pilot solenoid 8. In a cooling operation the hot discharge gas passes through one outlet 9 of the valve to condenser 10 where it is liquefied and passed to receiver 11 where the liquid refrigerant is stored. From the receiver it passes through line 12 to and through the heat exchanger 13 and line 14 to the expansion valve 15 and into and through the evaporator 16 where the refrigerant is vaporized. The vaporized refrigerant then passes through line 17 back into heat exchanger 13, and then through line 18 into the accumulator 19 from whence it passes back through suction line 20 to the suction side of the compressor 2. In the cooling operation the other outlet 21 of the three-way valve 7 is closed so that the connected hot gas line 22, which includes one branch 23 leading to the defrost drain pan 24, and another branch 25 leading to a check valve 26 at the receiver 11, is at a pressure which reflects the evaporator pressure since the check valve 26 is in a closed position because of the relatively high pressure in the receiver 11.

For operation in the heating or defrost mode, the pilot solenoid 8 shifts the three-way valve to the opposite position so that outlet 9 is shut and outlet 21 is opened to the hot gas received by the valve from the discharge line 6. The primary flow of the hot gaseous refrigerant from line 2 is through line 23, through the defrost pan heater 24 through lines 27 to a distributor adaptor 28 and then through evaporator 16 in the same direction as in a cooling mode. A minor part of the hot gas passes from the hot gas line 22 through the line 25 and through the bypass check valve 26 into the receiver tank. The pressure against the liquid in the tank forces the liquid through the line 12 to the expansion valve 15 in the same manner as in cooling where the liquid passes through a small opening to join with and mix with the hot gas passing into the evaporator.

A hot gas pressure or temperature responsive switch 29 is subject to the pressure in the hot gas line and has a first position corresponding to a pressure below a predetermined value and a second position corresponding to a pressure above the predetermined value to function in a control arrangement as will be hereinafter described. While the description will proceed in connection with the switch being pressure sensitive, it will be appreciated that since refrigerant pressures and temperatures vary with each other the switch may also take the form of being temperature responsive to the line which will correspond with particular pressures in the line.

The means for providing air flow through the two sections of the refrigeration unit are not shown since they are readily known in the art. Bascially, air from the served space 1 is drawn into the evaporator section and discharged back into the served space, while outdoor air is brought into the section with the condenser 10 and passes therethrough back to ambient.

Figure 2:
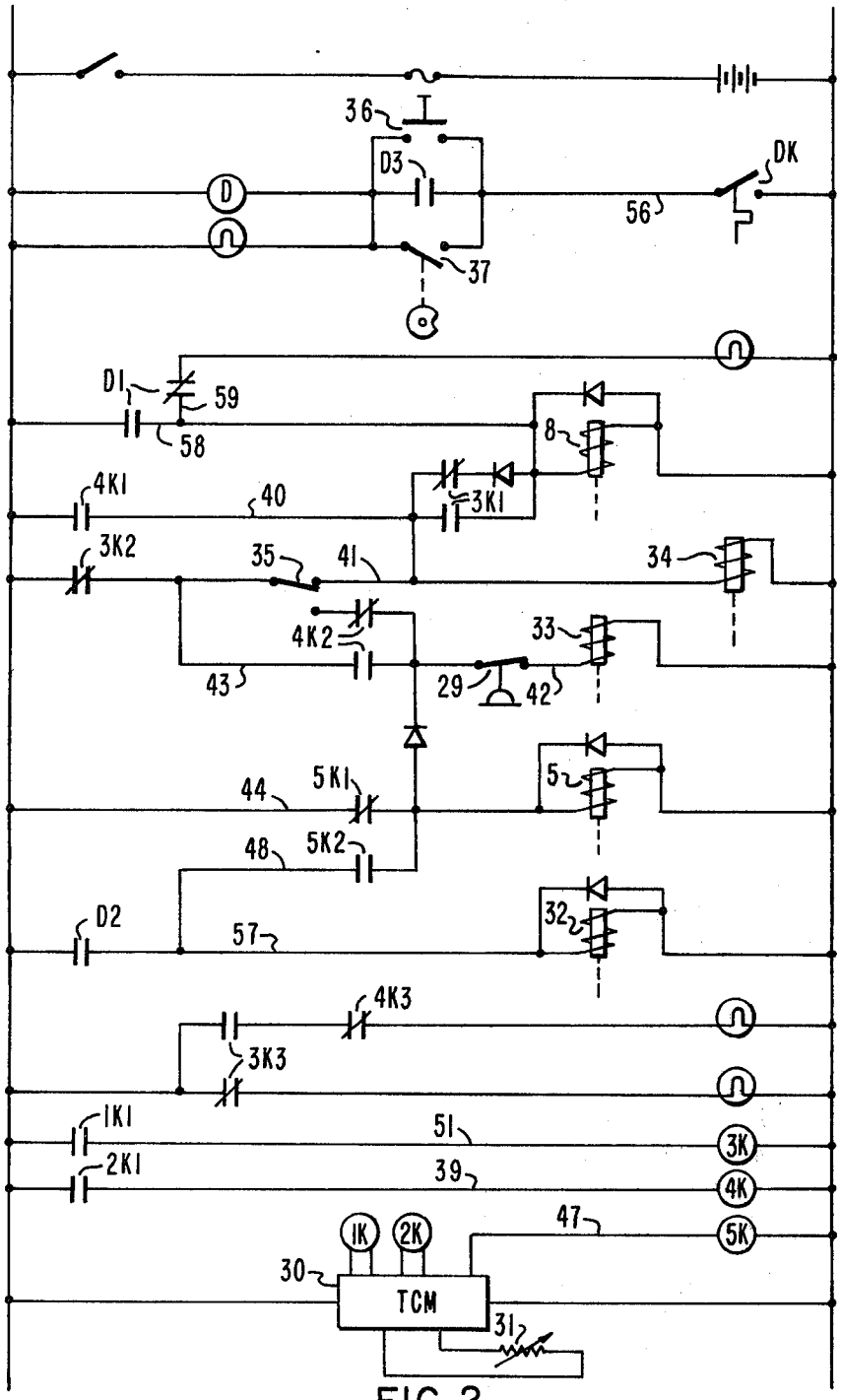
FIG. 2 is a schematic diagram of one form of control system according to the invention.

Referring to FIG. 2, the circuit arrangement controlling the refrigeration unit of FIG. 1 in accordance with the invention is shown. The circuit of FIG. 2 is not complete with respect to total control of the unit, but is limited for the most part to those aspects of the control with which the invention deals. Thus, parts relating to starting of the engine, certain safety switches, starter-generator, for example, are omitted for purposes of simplicity.

A temperature control module or thermostat 30 responsive to changes in temperature of the spaced served by sensor 31 effects temperature control through operation of first or heat relay 1K, second or speed relay 2K, and through energization of relay 5K, and through their control switches which are correspondingly identified. Other elements of FIG. 2 which are believed to require identification for a proper understanding of the operation include, in basically ascending order: a damper solenoid 32 which functions to block air flow across the evaporator in a defrost operation; the throttle solenoid 5 noted previously in connection with FIG. 1; the hot gas pressure switch 29 shown in a position corresponding to a pressure below the predetermined value at which it operates to the opposite position, the switch in its illustrated position completing a part of a circuit including loading solenoid 33 which, when energized, results in the loading of two of the cylinders, of the three cylinder compressor; the other loading solenoid 34 which, when energized, loads the other cylinder of the compressor; a thermal lock-out switch 35 operated by a cam (not shown) from its illustrated position to the opposite position whenever the temperature setpoint of the temperature control is set for below 15° F. (−9° C.); the pilot solenoid 8 noted in connection with FIG. 1; the defrost relay D and its correspondingly identified control switches; and the manual defrost switch 36 and an automatic defrost switch 37. All of the relay control switches shown in FIG. 2 are shown in their positions corresponding to deenergization of the particular relay.

OPERATION

Figure 3:
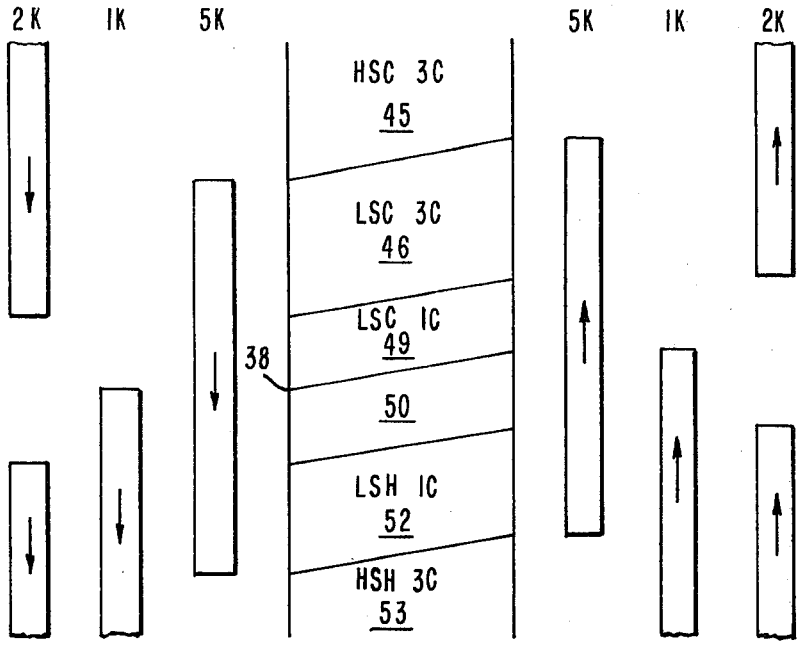
FIG. 3 is a representation of the operating sequence as temperatures change and various relays and switches operate with a thermostat setpoint above a given low temperature.
Figure 4:
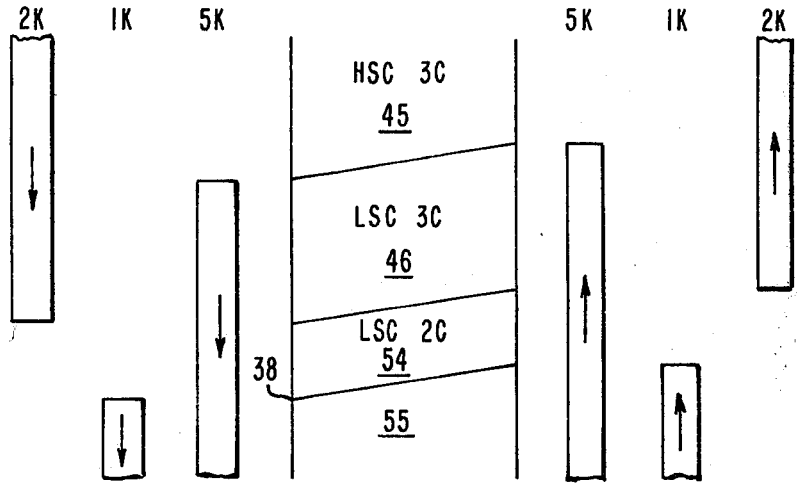
FIG. 4 is a representation of the sequence with the thermostat setpoint below the given setting.

To aid in quickly grasping the operation of the circuit and the sequence of relays and switches, reference should be had to FIGS. 3 and 4. FIG. 3 corresponds to the operation when the thermal lock-out switch 35 is in a position corresponding to a setpoint temperature in excess of 15° F. (−9° C.) while FIG. 4 corresponds to operation with the thermal lock-out switch in the opposite position. The bars indicating energization of the relays 1K, 2K and 5K are shown at both the left and the right side of the intermediate block, those on the left side corresponding to falling temperatures and those on the right side corresponding to rising temperatures in the served space.

The abbreviations in the blocks in FIGS. 3 and 4 such as HSC stand for the mode of operation, such as high speed cool, and the numeral associated with the C in each block designates the number of cylinders operating.

Referring to FIGS. 2 and 3, and assuming the temperature in the served space is well above the setpoint temperature, which is indicated at the level 38 in both FIGS. 3 and 4, the relay 2K will be energized in high speed cooling with all three cylinders loaded. 2K1 will be closed in the circuit 39 which includes relay coil 4K, which is thereby energized. The pilot solenoid 8 is in a deenergized condition so that the three-way valve is in a cooling mode. The loading solenoid 34 for the single cylinder of the compressor is energized through either of two alternate ways at this point, the line 40 including closed switch 4K1 and, alternatively, the line 41 including closed switch 3K2 and the thermal lock-out switch 35 in the illustrated position. The loading solenoid 33 in line 42 for the two other compressor cylinders is also energized through any of several alternative parallel circuits, one being through closed switch 3K2, line 43 and the closed switch contacts of switch 4K2 in line 43 to the hot gas pressure switch 29. The other alternate completion of the circuit is through switch 5K in line 44 also leading to the hot gas pressure switch. The throttle solenoid 5 will also be energized for high speed operation through the closed switch contacts of 5K in line 44. This operation then is for high speed cooling, three cylinders loaded as indicated by the block 45 in both FIGS. 3 and 4.

As the temperature in the served space decreases toward the level of the setpoint, 38, but at a temperature still well above the setpoint, such as 8° F. (5° C.) thereabove, the unit will go to low speed cool with three cylinders loaded as indicated by the block 46 in both FIGS. 3 and 4. This change in operation occurs because the 5K relay coil in line 47 is energized through the temperature control module 30. What occurs in the circuit of FIG. 2 is that switch contacts 5K1 in line 44 leading to the throttle solenoid open while switch contacts 5K2 in line 48 close. As a result, the speed of the engine is reduced.

Upon a further drop in temperature to a few degrees above the setpoint temperature, the temperature control module 30 (FIG. 2) will cause deenergization of relay 2K. Switch contacts 2K1 in line 39 will open and deenergize relay coil 4K. The switch contacts of 4K2 in line 43 will open and the circuit through the hot gas pressure switch 29 and line 42 to the loading soleoid 33 for the two cylinders is incomplete. However, the circuit to the loading solenoid 34 remains complete through switch 3K2 and the thermal lock-out switch 35. The low speed cooling, one cylinder block in FIG. 3, is indicated by the numeral 49.

As the temperature in the served space drops to slightly below the setpoint, the relay coil 1K is energized and the unit goes into a null mode of operation as indicated by the block 50 in FIG. 3. When coil 1K is energized its switch 1K1 in line 51 closes and energizes the 3K relay coil in the same line. With switch contacts 3K2 open in line 41, energization to both of the solenoids 33 and 34 is lost so that the compressor operates completely unloaded.

With a further drop in temperature below the setpoint to a level that the relay 2K is again energized along with continued energization of both 1K and 5K, the operation will change to low speed heat with one cylinder as indicated in box 52 in FIG. 3. With the energization of the three relay coils noted, energization of the relay coils 3K and 4K (FIG. 2) automatically follows. The closure of switch contacts 4K1 in line 40, and operation of switch 3K1 to the position opposite shown in FIG. 2 results in energization of the pilot solenoid 8 and the operation of the three-way valve to a heating position. The single cylinder loading solenoid 34 is also energized through the same switch contacts 4K1.

Upon a further drop in temperature of the served space, indicating a need for increased heating, high speed heating with three cylinders as indicated in block 53 (FIG. 3) begins. Deenergization of the relay coil 5K (FIG. 2) in line 47, so that its switch contacts 5K1 are closed in line 44, results in both energization of the throttle solenoid 5 for high speed operation, as well as energization of the two cylinder loading solenoid 33 in line 42. The single cylinder loading solenoid 34 is energized through 4K1.

The sequence of modes of operation with rising temperatures from a temperature in the served space well below the setpoint will be understood from the previous explanation taken with the fact that the same relay coils are involved in changes of temperature. Under normal operating circumstances slight changes in the served space temperature results in the most of the time of operation corresponding to those shown in blocks 49, 50 and 52 of FIG. 3. This is advantageous in a number of respects, and particularly in connection with fuel economy since low speed operation and an unloaded condition both contribute to this.

When the circuit arrangement of FIG. 2 has the thermal lock-out switch 35 in the position opposite from that shown, a high speed cool with three cylinders loaded corresponding to block 45 in FIG. 4 occurs, the only significant change being that the loading solenoid 34 for the single cylinder is incapable of being energized through the terminal lock-out switch 35 but it does receive energization at this time through switch contact 4K1 and line 40.

The low speed cool with three cylinders loaded, corresponding to block 46 in FIG. 4 is basically the same operation as described in connection with FIG. 3, the change from the high speed cool to the low speed cool occurring because of the energization of 5K relay coil.

At a degree or so above the setpoints 38 temperature level in the served space, a low speed cool with two cylinders loaded as indicated in block 54 of FIG. 4 occurs. This occurs because the deenergization of relay coil 2K results in deenergization of relay coil 4K and the opening of switch 4K1 in line 40. As a result the single cylinder loading solenoid 34 is deenergized so that a two cylinder loading exists.

A further decrease in served space temperature below the setpoint 38 results in a null operation corresponding to the block 55. In this mode, the relay coils 1K and 5K are both energized which also energizes relay coil 3K so that its switch contacts 3K2 open and result in deenergization of the two cylinder loading solenoid 33 also. Thus in this mode of operation no cylinder is loaded and the engine operates at a low speed. With the thermal lock-out switch 35 in the position for the FIG. 4 sequence of operation, the unit is incapable of providing heating.

The reverse sequence of modes of operation with rising temperatures are obtained with energization of the relays as indicated on the right side of FIG. 4.

For operation of the circuit of FIG. 2 in defrost, closure of either switch 36 or 37 results in energization of the defrost relay coil D and its controlled holding switch D3 in line 56, the closure of D2 in line 57 to energize the damper solenoid 32 and the closure of the switch contacts of D1 in line 58 and the opening of that switch's contacts in the line 59. The closed D1 contacts in line 58 will insure the energization of the pilot solenoid 8 so that the three-way valve shifts to a heating mode. Since the defrost operation is to be carried out with all cylinders loaded and at high speed the loading solenoids 33 and 34 are energized and the throttle solenoid 5 is also energized. Energization for the loading solenoid 34 is available through D1 in line 58, 3K1 in either of its positions. Energization for the loading solenoid 33 and for the throttle solenoid 5 is available either through switch 5K1 if 5K is energized, or alternatively through switch D2 and contacts 5K2 if 5K is not energized.

If during any of the heating cycles or defrosting cycles the hot gas pressure in the hot gas line 22 exceeds the predetermined value to which the switch 29 is set, the switch operates to the position opposite that shown in FIG. 2 and as a result the loading solenoid for the two cylinders is deenergized so that the continued operation is with a single cylinder loaded. The predetermined pressure value is of course determined in accordance with the pressures which can result in overload of the compressor. Thus, the value may be set at 175 psig for example.

By providing the hot gas switch so that it is responsive only to the pressure in the hot gas line which will have a significant pressure value only during the heating or defrost modes of operation, the discharge pressure can be limited to a relatively lower value for the heating and defrosting operations without penalizing the system during a cooling operation when significantly higher discharge pressure values occur and are desirable but without the problem of an overload.

In the illustrated arrangement the circuit is such that the switch 29 needs only to open the line 42 to the solenoid 33 for the two cylinders since in any condition of defrost or heating, the single cylinder solenoid is energized through other circuits. However, it is contemplated that with other circuits the switch 29 may desirably be a double pole switch to insure energization of single cylinder solenoid 34 upon deenergization of solenoid 33 from a high pressure.

We claim:

1. The combination of:

a transport refrigeration unit including prime mover means driving a multi-cylinder, unloadable compressor adapted to operate in a cooling mode, or alternatively in a heating and defrost mode, in accordance with the positioning of a three-way valve receiving hot gas discharged by said compressor, said valve having its one outlet connected to a refrigerant condenser and its other outlet connected to a hot gas line extending to a refrigerant evaporator, said hot gas line in a cooling mode having a pressure reflecting the evaporator pressure, and in a heating and defrost mode having a pressure corresponding generally to the gas discharge pressure;

with a control system including:

switch means responsive to the refrigerant pressure in said hot gas line;

first circuit means including a first solenoid for controlling the loading of at least one of the cylinders of said compressor;

second circuit means including a second solenoid for controlling the loading of the remainder of the cylinders;

each of said circuit means including switch means responsive to changes in temperature of the space conditioned by said refrigeration system and independently operable to positions to unload said at least one cylinder and said remainder of cylinders in accordance with demand conditions of said space;

said switch means responsive to pressure having a first position corresponding to a pressure below a predetermined value placing said second circuit means in a condition in which said second soleoid causes loading of said remainder of cylinders, and having a second position corresponding to a pressure above the predetermined value placing said second circuit means in an opposite condition in which said second solenoid causes unloading of said remainder of cylinders;

whereby said system can operate in a cooling mode in loaded condition with gas discharge pressures significantly higher than said predetermined value.

2. The combination of claim 1 wherein said prime mover comprises an internal combustion engine having multi-speeds.

3. The combination of claim 1 wherein said remainder of the cylinders comprises twice the number of said at least one of the cylinders.

* * * * *